US006116752A

United States Patent [19]

Mayfield et al.

[11] Patent Number: 6,116,752

[45] Date of Patent: Sep. 12, 2000

[54] HOLIDAY DECORATION WITH COVERED LIGHT STRING HAVING PROJECTING LIGHTS

[75] Inventors: Lisa Mayfield; Michael A. Stewart, both of Salem, Oreg.

[73] Assignee: Tree Bon!, Salem, Oreg.

[21] Appl. No.: 09/013,731

[22] Filed: Jan. 27, 1998

[51] Int. Cl.[7] ..... F21S 13/14

[52] U.S. Cl. ..... 362/252; 362/249; 362/227; 362/397; 362/806

[58] Field of Search ..... 362/227, 249, 362/250, 252, 806, 807–809, 145, 397, 391

[56] References Cited

U.S. PATENT DOCUMENTS

| | | | |
|---|---|---|---|
| 2,052,425 | 8/1936 | Simeone | 362/250 |
| 3,404,268 | 10/1968 | Fowler | 240/10 |
| 3,500,036 | 3/1970 | Szentveri . | |
| 3,731,081 | 5/1973 | Yellin . | |
| 3,894,225 | 7/1975 | Chao | 240/1 |
| 4,537,806 | 8/1985 | Sherrard | 428/7 |
| 4,570,206 | 2/1986 | Deutsch . | |
| 4,657,800 | 4/1987 | Long | 428/102 |
| 4,839,777 | 6/1989 | Janko et al. . | |
| 5,110,078 | 5/1992 | Gary | 248/206 |
| 5,295,055 | 3/1994 | Brock et al. | 362/249 |
| 5,315,492 | 5/1994 | Davenport | 362/122 |
| 5,416,678 | 5/1995 | Schabowski . | |
| 5,477,437 | 12/1995 | Lach . | |
| 5,544,028 | 8/1996 | Carlin | 362/249 |
| 5,624,181 | 4/1997 | Miller et al. . | |
| 5,639,521 | 6/1997 | Fraus et al. . | |

OTHER PUBLICATIONS

Standard Handbook of Fastening and Joining, second edition; Parmley, Robert O.; Mc Graw–Hill Publishing Company; section 4–47, 1989.

*Primary Examiner*—Sandra O'Shea
*Assistant Examiner*—Ismael Negron
*Attorney, Agent, or Firm*—Klarquist Sparkman Campbell Leight & Whinston LLP

[57] ABSTRACT

A holiday decoration includes first and second strands, at least one of which is a covered strand of lights. The covering may be a strip of flexible material with lights projecting outwardly from the covering. In one form, the covering is a folded strip having apertures through which the lights project and overlaying side edge portions which are joined together. In another form, first and second flexible strips of material are sandwiched together and joined along their respective side edge portions with lights projecting outwardly through gaps between the side edge portions. One of the strands is mounted to an upright surface, such as of a window pane, and positioned to outline the shape of a tree or other holiday symbol. The other strand is mounted to the surface and is positioned primarily within the boundary defined by the first strand.

21 Claims, 3 Drawing Sheets

FIG. 3
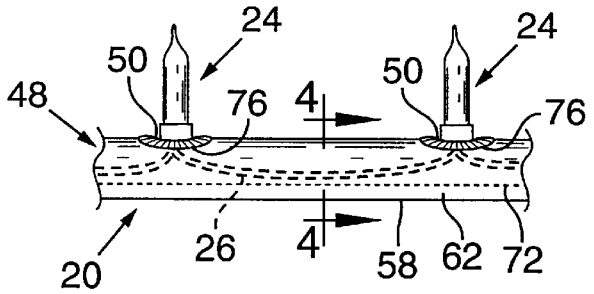
FIG. 4
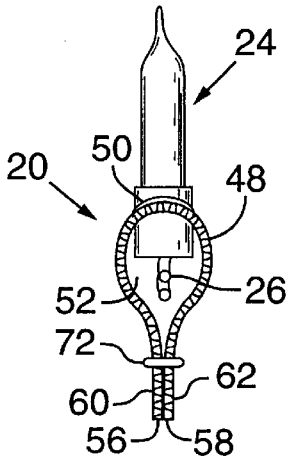
FIG. 5A
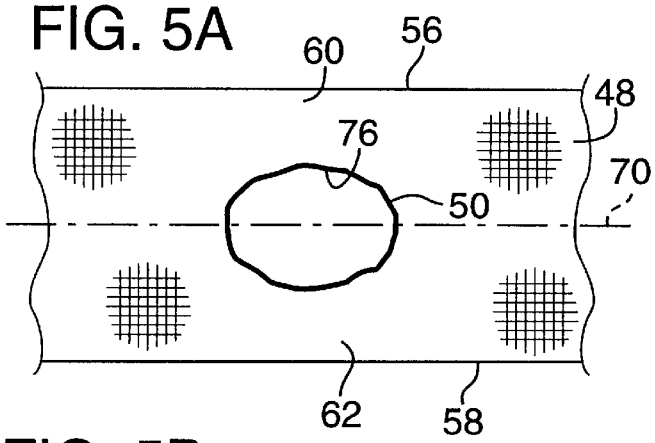
FIG. 5B
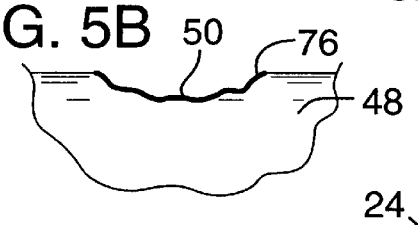
FIG. 6A
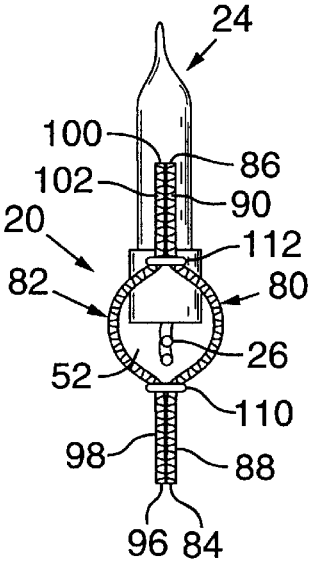
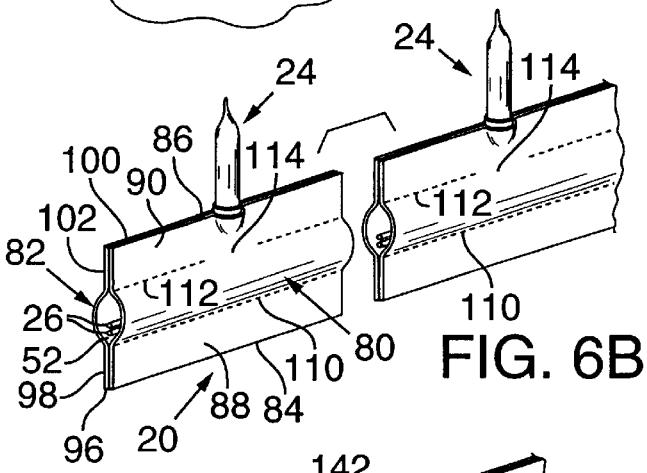
FIG. 6B
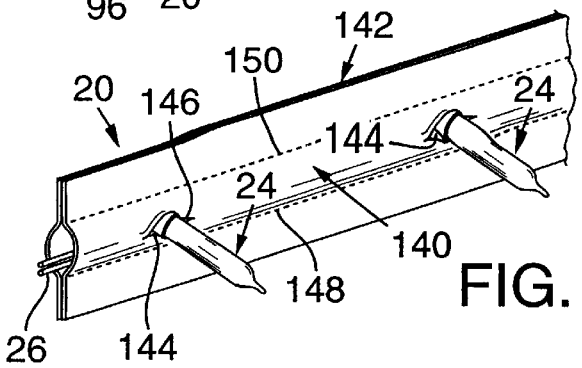
FIG. 7

HOLIDAY DECORATION WITH COVERED LIGHT STRING HAVING PROJECTING LIGHTS

BACKGROUND OF THE INVENTION

The present invention relates to holiday decorations, such as used at Christmas or during other holidays, and also to a decorative covered light string for use in such decorations and otherwise in decorating.

Strings of electrical conductors or wires with spaced apart sockets and incandescent lights, including miniature lights, have been available for many years for use in both interior and exterior decorations, such as Christmas decorations. It is common practice for the wires to be electrically insulated with the insulation being green, to blend in with a Christmas tree, or white, to blend in with other backgrounds. However, the insulated electrical wires are visible and may detract from the decorative effect of the light string.

U.S. Pat. No. 5,477,437 to Lach discloses an illuminated flag having a string of lights sandwiched between sheets of fabric material. Light bulbs of the string project outwardly beyond the exterior surface of the sheet material. In one embodiment, one sheet of material is a flap in the shape of an evergreen Christmas tree, which is sewn to the flag. In another embodiment, the sheet is in the form of a pumpkin. In Lach, the electrical wires are hidden between sheets of material, but the lights are held in a fixed position on the flag so that one must accept the design that comes with the flag when it is purchased.

U.S. Pat. No. 5,639,521 to Fraus et al. shows an ornamental Christmas display for mounting to a wall surface. This display has a background in the shape of a tree to which a string of Christmas tree lights is mounted, the light string having exposed insulated wires.

Suction cups have also been used for a number of years to mount light strings to window panes for decoration purposes.

Although holiday decorations with light strings exemplified by this prior art are known, a need exists for a holiday decoration and a decorative light string which is easy to store, provides great flexibility to the user in customizing the decoration, and which is extremely attractive.

SUMMARY OF THE INVENTION

In accordance with one aspect of the present invention, a holiday decoration may be temporarily attached to an upright surface, such as the interior surface of a window pane located in the exterior wall of a building. A first elongated flexible strand is mounted to the window pane in a shape to define the outline of an object which is a symbol of a holiday. For example, the strand may be oriented to define the outline of an evergreen Christmas tree. A second elongated flexible strand is mounted to the upright surface with a majority of the second strand preferably positioned within the outline defined by the first elongated strand. At least one of the first and second strands comprises a string of spaced apart lights with electrical wire extending between the lights. Because of their flexible nature, the first and second strands may be oriented on the wall surface in shapes which reflect the desired customization and creativity of the user. The electrical wire of the light string is covered by an elongated flexible covering with the lights projecting outwardly from the covering. When mounted to a surface of a window pane, such as the interior surface of the pane, the decoration is visible through the window pane from the exterior of the building, as well as from within the building.

Most preferably, one of the elongated flexible strands is a strand of beads. Either the beads or the light string may be used to define the outline of the holiday object.

Ornaments may also be affixed to the wall surface, such as to the window pane to further decorate the holiday decoration, such as in the case of a Christmas tree decoration.

The preferred form of decoration has substantial height and width, but an insubstantial depth with the decoration being almost flat against the surface to which it is mounted. Consequently, the decoration projects only slightly into a room, and typically much less than the depth of a window casing surrounding the window pane to which the decoration is mounted. Therefore, in this case the decoration does not project outwardly over floor space of the room and consequently does not interfere with the use of the room.

Most preferably, the flexible covering encloses the electrical wire with the lights, including a portion of a light socket and incandescent lamp in one embodiment, projecting outwardly from the covering. The covering preferably comprises at least one elongated strip of flexible material, such as a fabric material. The strip extends lengthwise along the string of spaced apart lights and defines apertures through which the lights project.

In accordance with a first embodiment of a covered light string, the elongated strip includes respective first and second side edges extending lengthwise along the strip and side edge portions or margins along the side edges. The strip also includes a plurality of spaced apart apertures spaced inwardly from the side edge portions and side edges of the strip. The side edge portions of the strip are folded over to engage one another and are interconnected so that the strip defines an interior channel between the folded-over portions of the fabric. The electrical wires are positioned within the channel with the lights of the light strand projecting outwardly through the apertures.

In a specifically preferred form of the invention, although other materials may be used, the flexible covering is of heat-fusible fabric material and the boundaries of the apertures are heat fused.

In an alternative construction, first and second elongated strips of flexible material are used to cover the electrical wires of the light string. Each of these strips has respective first and second side edge portions with the strips being positioned to overlay one another. More specifically, the first side edge portion of the first strip is adjacent to the first side edge portion of the second strip and the second side edge portion of the first strip is adjacent to the second side edge portion of the second strip. The first side edge portions of the first and second strips are preferably interconnected along their length except at spaced apart gap locations, while the second side edge portions are preferably interconnected along their entire length. When the light string is positioned within the covering, the lights and sockets project outwardly through the respective gaps, with the gaps thus comprising apertures for the lights. In addition, the two strips define an interior channel within which the electrical wire is positioned. This channel is located between the strips and between the seam along which the first side edge portions of the strips are interconnected and the seam along which the second side edge portions of the strips are interconnected.

The invention also involves a method of making a holiday decoration as described above and the decorative light strand with covered electrical conductors.

These and other features and advantages of the invention will become apparent from the drawings and description below.

BRIEF DESCRIPTION OF THE DRAWINGS

FIG. 3 is a side elevational view of a portion of a decorative strand of lights in accordance with an embodiment of the present invention.

FIG. 4 is a vertical sectional view taken along lines 4—4 FIG. 3.

FIG. 5A is a top plan view of a portion of a fabric strip for use in making a decorative light string in accordance with the present invention.

FIG. 5B shows a portion of the strip of FIG. 5A folded over to form a decorative covering for a strand of lights in accordance with the present invention.

FIG. 6A is a vertical sectional view of a strand of lights with a covering formed of first and second interconnected elongated strips of flexible material.

FIG. 6B is a perspective view of a portion of a strand of lights in accordance with FIG. 6A.

FIG. 7 is a perspective view of an alternative embodiment of a decoratively covered strand of lights in accordance with the present invention.

DESCRIPTION OF THE PREFERRED EMBODIMENTS

Figure 1:
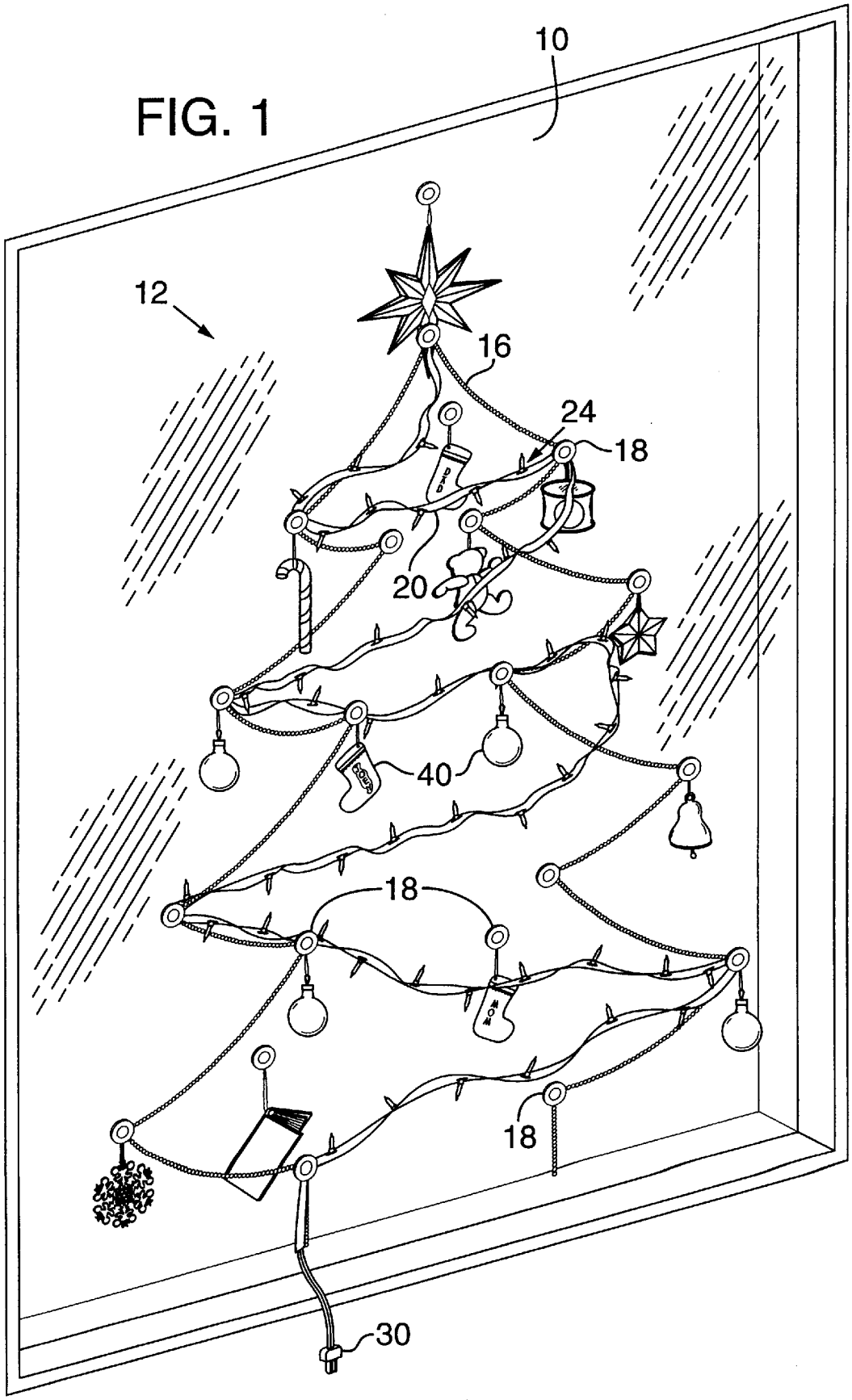
FIG. 1 one is a front elevational view of one form of a holiday decoration in accordance with the present invention.
Figure 2:
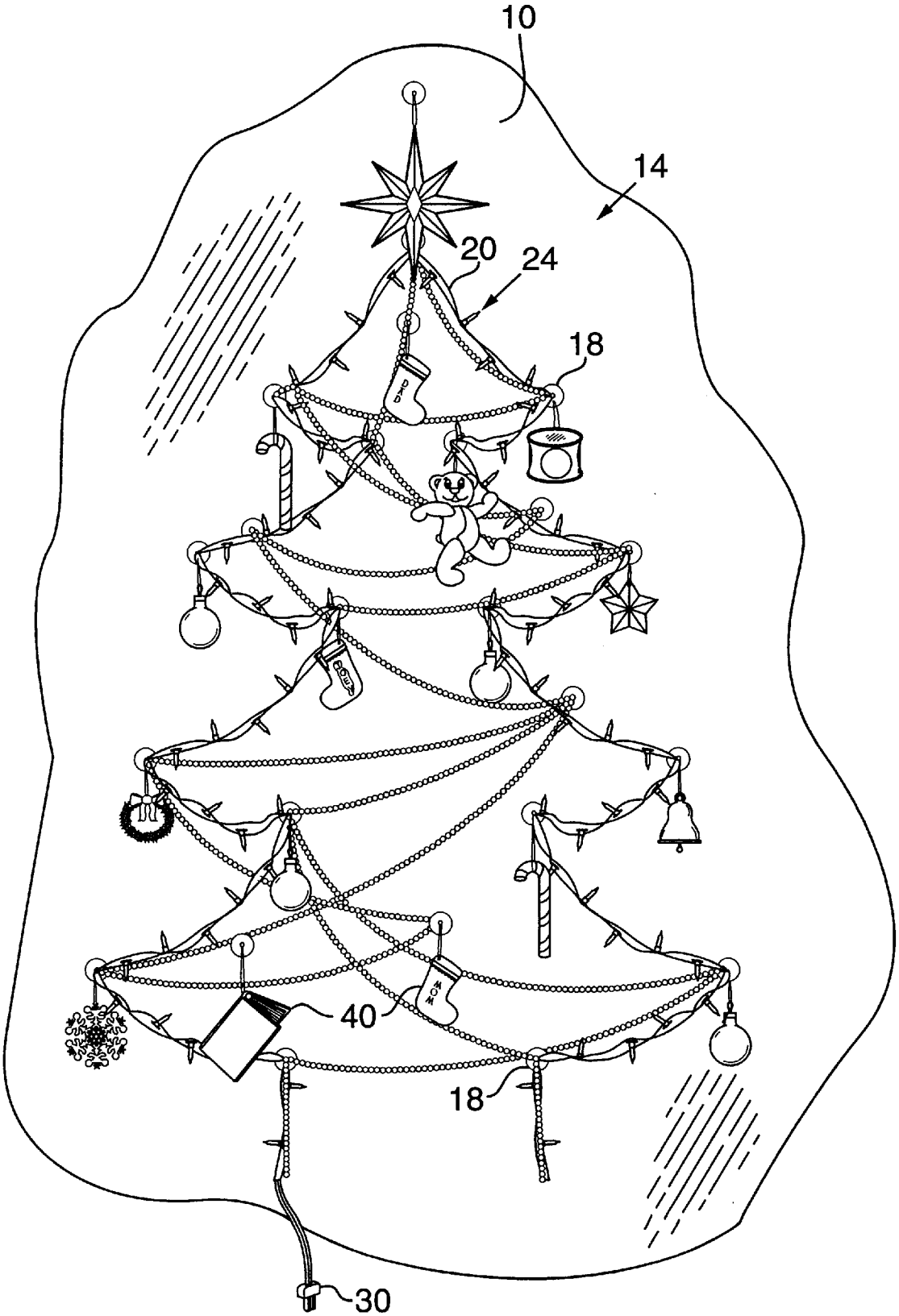
FIG. 2 is a front elevational view of a second form of a holiday decoration in accordance with the present invention.

FIGS. 1 and 2 illustrate a portion of a window pane 10 to which respective holiday decorations 12, 14 in accordance with the present invention are mounted. By window pane, it is meant to include panes of any style of window or door. For example, the term window pane is meant to include single panes, multiple divided panes, plural panes of double hung windows, as well as other window pane forms. Within the meaning of this application, the holiday decoration may span multiple panes of a window and is still be deemed mounted to a window pane. Most preferably, the window pane 10 is in an exterior window of a building so that the holiday decoration, when mounted, for example, to the interior surface of the window pane, is visible from both the exterior of the building and from the interior of the building. The holiday decoration may also be mounted to an upright surface of a wall as well as to other surfaces.

The decoration 12 includes a first elongated flexible strand, such as a strand of beads 16, configured to substantially define the outline of an object which is the symbol of a holiday. In this case, strand 16 is mounted to the window pane 10 utilizing temporary fasteners, such as commercially available suction cups hangers, some being indicated at 18. The strand 16, which is preferably a single continuous strand of beads, although it may be formed of multiple strands, spans or extends from suction cup hanger to suction cup hanger. In FIG. 1, the strand 16 is shaped to bound the outline of an evergreen tree, which is a symbol of the Christmas season. The individual who mounts the strand 16 to the window has artistic freedom to shape the tree as desired and is not confined to a preestablished fixed design. Other holiday symbols include, but are not limited to, a star for Christmas, a pumpkin for Halloween, a heart for Valentine's Day, and so forth.

The decoration 12 also includes a second elongated flexible strand 20 which is also mounted, such as by suction cup hangers, some being indicated at 18, to the window pane 10. A majority of the second strand, and most preferably substantially all of the second strand, is mounted to the window pane so as to be positioned within the outline defined by the first elongated strand 16. The strand 20 comprises a string of spaced apart lights, some being indicated at 24, interconnected by flexible insulated electrical wires 26 (see, for example, FIGS. 3 and 4) which forms a part of strand 20. The electrical wires 26 and lights 24 are conventional with the lights preferably being miniature incandescent lights secured in sockets electrically coupled to the wires 26. The light string 20 is energized when a plug 30 (FIGS. 1 and 2) is coupled to a wall socket or other source of electrical power.

In the embodiment of FIG. 2, the outline of the holiday symbol, in this case a tree, is substantially defined by the strand of lights 20 temporarily mounted to the window pane. The second strand 16 may be an unlighted strand such as a string or strand of beads, and is positioned preferably so that a majority of the strand is inside the boundary defined by strand 16. Most preferably the strand 16 is positioned substantially entirely within the interior of the outline defined by strand 20. In FIG. 2, strand 16 is illustrated as a double strand of beads.

Ornaments, some of which are indicated at 40 in FIGS. 1 and 2, are mounted, as by suction cup hangers, to the window pane in close association with the holiday object so as to form a portion of the decoration.

Thus, in the embodiments of FIGS. 1 and 2, first and second elongated flexible strands are provided, at least one of which comprises an elongated flexible strand of spaced apart lights with the lights being interconnected by electrical conductors which are covered. The other strand is most preferably unlighted and may comprise a string of beads. At least one of the strands is configured to substantially define an outline of a holiday object. The outline may be a closed geometric shape. By flexible, it is meant that the strands may be bent or draped into arbitrary desired shapes or configurations without damaging the strands.

The holiday decoration, in accordance with the embodiment of FIGS. 1 and 2, has substantial height and width dimensions, but an insubstantial thickness or depth dimension. In other words, the depth of the decoration is typically no more than an inch or two, depending upon how far the lights and ornaments project outwardly from the plane of the surface to which the decoration is mounted. In a typical mounting arrangement such as is shown in FIG. 1, the entire decoration is positioned within the recess defined by a window casing surrounding the window pane 10. Therefore, the decoration does not project into the room and overlie a portion of the floor space of the room. Consequently, an individual with extremely limited living space, such as in an apartment, nevertheless may have a customized and festive holiday decoration which does not interfere with other uses of the floor space. In addition, because of the flexible nature of the strand 16 and 20, following the holiday season, the entire decoration may be coiled or folded and stored in an extremely compact container.

The strand of spaced apart lights 20 has electrical wire that is covered by covering material with the light 24 projecting outwardly from the covering material. Consequently, the wires 26 forming the strand are substantially overlaid by the covering in a decorative manner.

In one approach, which is less preferred, the flexible covering is strip of ribbon which wrapped around the electrical conductor in a spiral-like fashion, leaving the lights free to project outwardly from the space between the wraps of ribbon. This approach may leave significant portions of the electrical wires exposed. In another more preferred approach, as shown in FIGS. 3–5B, the electrical covering is formed of at least one elongated strip 48 of flexible fabric material extending lengthwise along the string of spaced apart lights. Apertures (some being indicated at 50 in FIG. 3) are provided in the strip 48 through which the lights 24 project. Again, in FIG. 3, the lights 24 in one form consist of a socket into which an incandescent bulb is mounted. As shown in FIGS. 3 and 4, the strip 48 defines an interior channel 52 within which the electrical conductors 26 are enclosed. Preferably the covering extends along a major portion of the length of the light strand and most preferably the covering extends at least along the entire length of the portion of the light string that includes lights 24.

In forming the covering of FIGS. 3 and 4, the fabric strip is in essence folded to bring first and second side edges 56, 58 of the fabric together, and more specifically, to bring side edge portions 60, 62 of the fabric into an abutting or adjacent relationship. The apertures 50 are positioned inwardly from the side edge portions 60, 62 and typically along the longitudinal center line of the fabric strip as indicated at 70 in FIG. 5A. The side edge portions 60, 62 of the strip 48 are interconnected (for example by stitching, or otherwise) along their length, such as indicated by a continuous seam at 72 in FIG. 3, so as to enclose a channel 52. As shown in FIG. 3, the boundary or perimeter of 76 of the aperture 50 may be finished to reinforce the aperture and to enhance the aesthetic appearance of the decorative light strand. For example, buttonhole stitching may be used along the perimeter or a grommet may be installed along the perimeter. Alternatively, the strip may be formed of a heat fusible material. In such a case, the seam 72 may be formed, for example, by heat fusing the side edge portions 60, 62 together. In addition, the perimeter 76 of the aperture, such as shown in FIG. 5B, in this case may be heat fused. As a specific example, a hot knife may be used to cut the aperture 50 in which case the edges of the aperture will be fused during the aperture forming step.

An alternative construction of the decorative light strand 20 is shown in FIG. 6. In the FIG. 6 embodiment, the covering is formed of first and second strips 80, 82. Strip 80 has a first elongated side edge 84 and a second elongated side edge 86. In addition, strip 80 has a first side edge portion 88 positioned inwardly from the side edge 84 and a second side edge portion 90 positioned inwardly from side edge 86. Similarly, strip 82 has a first elongated side edge 96, a first elongated side edge portion 98, adjacent to side edge 96, a second side edge 100 and a second side edge portion 102, adjacent to side edge 100. In making the decorative light strand of FIG. 6, the respective first side edge portions 88, 98 are placed adjacent to one another in an overlapping, or sandwiched abutting arrangement and the second side edge portions 90, 102 are similarly positioned adjacent to one another. The side edge portions 88, 98 are interconnected along their length, such as by stitching 110, or by another suitable approach with heat fusion being an example. In addition, the side edge portions 90, 102 are also interconnected along their length, except that spaced apart gaps 114 in the interconnection of side edge portions 90, 102 are provided with the gaps 114 comprising apertures or slits through which the lights may project, as shown by the lights 24 in FIGS. 6A and 6B. Two of these gaps 114 are readily apparent in FIG. 6B. As is also apparent from FIG. 6B, a channel 52 is defined by the strips 80, 82 with the channel being positioned between the seams 110, 112 for receiving the electrical wires 26 therein.

Another alternative construction of the decorative light strand 20 is shown in FIG. 7. In the FIG. 7 embodiment, the covering is also formed of first and second strips 140, 142 which are sandwiched together with the major surface of strip 140 against a major surface of strip 142. In addition, the strip 140 is provided with a plurality of apertures 144 (two being shown in FIG. 7) through which the lights may project, as shown by the lights 24 in FIG. 7. The perimeters 146 bounding the apertures 144 may be finished, such as being heat fused or stitched, so that the apertures resist tearing. A hot knife may be used to cut the apertures 144 (e.g. in the form of a slit), in which case the edges of the aperture will be fused during the aperture forming step. Elongated seams 148, 150 are provided to join the strips 140, 142 together along the length of the decorative light strand. These seams may be formed by stitching, heat fusing or in any other convenient manner, with heat fusing being a particularly preferred approach. The respective side edge margins of the strips 140, 142 may be joined together if desired to prevent the edges from spreading apart. For example, the side edge margins of strips 140, 142 between line 150 and the upper edges of the strips 140, 142 shown in FIG. 7 may be heat fused. In the same manner, the side edges of the strips 140, 142 between line 148 and the lower edges of these strips in FIG. 7 may also be joined together, such as by heat fusing these edges. If this approach is used, the seams 148 and 150 may be replaced by the joined together side edge margins of the strips 140, 142.

Most preferably the strip used in forming the covering of the light strand in FIGS. 3–5, although variable, is typically from one to four inches wide with one and one-half inches to two and one-half inches wide being a preferred example, and two and one-fourth inches wide being a specifically preferred example. In this latter case, when folded, the width of the covering is approximately one and one-eighth inches in the FIG. 3 embodiment. The strips utilized in the embodiment of FIGS. 6A, 6B and 7 are typically one-half of the width of the strips utilized in the FIG. 3 embodiment for a comparable width finished covered light strand.

Various flexible materials may be utilized for the light strand covering of the present invention. Most preferably the material is fabric. A specifically preferred heat fusible fabric material is a polyester, such as one hundred percent polyester with Lurex™ from C. M. Offray and Son, Inc. of Chester, N.J. The flexible material is preferably of an electrically non-conductive material so that, in the event the insulation covering the electrical wires 26 is damaged, the covering does not conduct electricity. Also, it is preferred that the covering material be fire-resistant.

Having illustrated and described the principles of our invention with reference to several preferred embodiments, it should be apparent to those of ordinary skill in the arts that the invention may be modified in arrangement and in detail without departing from such principles. We claim as our invention all such modifications as fall within the scope of the following claims and equivalents thereto.

We claim:

1. A holiday decoration comprising:

a window pane positioned in the exterior wall of a building;

a plurality of spaced part window pane mounts for detachable mounting to the window pane;

a first elongated flexible strand mounted directly to the window pane at least in part by the window pane mounts and positioned in a shape to define the outline of an object which is a symbol of the holiday, the first strand being unsupported between a plurality of the window pane mounts;

a second elongated flexible strand mounted directly to the window pane at least in part by the window pane mounts and with a majority of the second strand positioned within the outline defined by the first elongated strand;

at least one of the first and second strands comprising a string of spaced apart lights with electrical wire extending between the lights;

an elongated flexible covering overlying the electrical wire with the lights projecting outwardly from the covering; and whereby the holiday decoration is visible through the window pane from the exterior of the building and is also visible from within the building.

2. A holiday decoration according to claim 1 wherein the other of the first and second strands is an elongated string of beads which is positioned in a shape to define substantially the entire outer boundary of the object with the string of beads which sags where unsupported and wherein a majority of the second strand is positioned within the interior of the outer boundary.

3. A holiday decoration according to claim 1 in which the first string is a string of spaced apart lights and the second strand is an unlighted strand.

4. A holiday decoration according to claim 1 in which the second strand is a string of spaced apart lights and the first strand is an unlighted strand.

5. A holiday decoration according to claim 1 including first and second elongated strips, each strip having respective first and second side edge portions, the strips being positioned to overlay one another with the first side edge portion of the first strip being adjacent to the first side edge portion of the second strip and the second side edge portion of the first strip being adjacent to the second side edge portions of the second strip, the first side edge portions of the first and second strips being interconnected along their length except at spaced apart gap locations, and the second side edge portions being interconnected along their length, the lights projecting outwardly through the respective gaps with the gaps thereby comprising the apertures, and wherein the first and second strips define an interior electrical wire receiving channel between the interconnected first side edge portions of the first and second strips and the interconnected second side edge portions of the first and second strips.

6. A holiday decoration according to claim 1 in which the string of spaced apart lights, electrical wire extending between the lights and flexible covering are combined without any elongated metal wire components other than the electrical wire.

7. A holiday decoration according to claim 1 wherein the object is a tree and wherein the first strand is supported by window pane mounts in a shape which substantially bounds the outline of an object, the object having an interior within the bounded outline and an exterior outside the bounded outline, and wherein a majority of the second strand is positioned within the interior of the outline.

8. A holiday decoration according to claim 7 in which the window pane has an interior surface, the first and second strands being mounted to the interior surface of the window pane by the window pane mounts, the decoration including a plurality of spaced apart ornament mounts and a plurality of ornaments mounted by the ornament mounts to the interior surface of the window pane within the interior of the outline of the tree, whereby the holiday decoration has a substantial height and width and an insubstantial depth so as to minimize the projection of the decoration into the interior of the building.

9. A holiday decoration according to claim 1 in which said at least one elongated strip includes respective first and second side edges extending lengthwise along the string of spaced apart lights and side edge portions along the side edges, the strip also including a plurality of spaced apart apertures positioned inwardly from the side edge portions and side edges of the strip, the side edge portions of the strip being folded over to engage one another and being connected to one another such that the strip defines an interior channel within which the electrical wire is positioned with the lights projecting outwardly through the apertures.

10. A holiday decoration according to claim 9 in which the flexible covering is of a heat fusible material, the apertures each being bounded by a boundary of the heat fusible material, and wherein the boundaries of the apertures are heat fused and wherein the side edge portions are also heat fused.

11. A method of making a holiday decoration comprising:

attaching a first elongated flexible strand to an upright surface of the wall at a plurality of spaced apart locations to define an outline of an object which is a symbol of the holiday;

attaching a second elongated flexible strand to the upright surface of the wall at a plurality of spaced apart locations so as to be substantially positioned within the outline of the object;

providing at least one of the first and second strands as a string of spaced part lights with electrical wire extending between the lights; and covering the electrical wire with an elongated flexible covering so as to conceal the electrical wire with the lights projecting outwardly from the covering.

12. A method according to claim 11 in which the other of the first and second strands is a string of beads which defines the outline.

13. A method according to claim 11 in which the outline is in the shape of a tree.

14. A method according to claim 11 wherein upright surface of a wall is a window pane and in which the first and second strands are coupled by spaced apart mounts directly to the window pane.

15. A method of making a holiday decoration according to claim 11 in which the act of covering the electrical wire comprises the act of providing an elongated strip of flexible fabric material which includes a plurality of spaced apart apertures positioned inwardly from the side edges of the strip, folding the strip to position side edge portions of the strip adjacent to one another, and interconnecting side edge portions of the strip to define an interior channel within which the electrical wires are positioned with the lights projecting outwardly through the apertures.

16. A method according to claim 14 including the step of heat fusing the boundaries of the apertures.

17. A method of making a holiday decoration for mounting to an upright surface of a wall, the decoration comprising:

attaching a first elongated flexible strand to the upright surface of the wall at at a plurality of spaced apart locations to define an outline of an object which is a symbol of the holiday;

attaching a second elongated flexible strand to the upright surface of the wall at a plurality of spaced apart locations so as to be substantially positioned within the outline of the object;

providing at least one of the first and second strands as a string of spaced part lights with electrical wire extending between the lights;

covering the electrical wire with an elongated flexible covering so as to conceal the electrical wire with the lights projecting outwardly from the covering;

the covering step comprising the step of providing first and second elongated strips each with respective first and second side edges and first and second side edge portions, sandwiching the first and second strips together with the first side edge portion of the first strip adjacent to and overlaying the first side edge portion of the second strip and with the second side edge portion of the first strip adjacent to and overlaying the second side edge portion of the second strip, interconnecting the respective first side edge portions of the first and second strips along their length and the second side edge portions of the first and second strips along their length, except that the first side edge portions are not interconnected at spaced apart gap locations along their length, the interior space between the first and second strips and between the interconnected first side edge portions and interconnected second side edge portions defining a channel for receiving the electrical wire of the light string and the gaps being apertures through which the lights project from the covering.

18. A decorative strand of lights comprising:

a string of spaced apart lights having electrical wire extending between the lights;

a flexible covering enclosing the electrical wire with the lights projecting outwardly from the covering, the covering comprising at least one elongated strip of flexible fabric material extending lengthwise along the string of spaced apart lights and defining apertures through which the lights project; and in which said at least one elongated strip includes first and second side edges and first and second side edge portions, a plurality of spaced apart apertures positioned inwardly from side edges of the strip, the strip being folded to position the side edge portions in an overlaying relationship, the side edge portions being connected to one another to define an interior channel between the folded over portions of the strip within which the electrical wires are positioned, and wherein the lights project outwardly through the apertures.

19. A decorative strip according to claim 18 in which the flexible material is heat fused along the boundaries of the apertures.

20. A decorative strip comprising at least one strand of spaced apart lights interconnected by electrical wire, the decorative strip also comprising first and second elongated strips, each strip having respective first and second side edges and first and second side edge portions, the strips being sandwiched together with the respective first side edge portions of the first and second strips overlying one another and the respective second side edge portions of the first and second strips overlying one another, the first side edge portions of the first and second strips being interconnected along their length and the second side edge portions of the first and second strips being interconnected along their length except that the first side edge margins are not interconnected at spaced apart gap locations along their length such that the lights can project outwardly through the respective gaps, whereby the gaps comprise the apertures and wherein the interior space between the strips and between the interconnected first side edge portions and interconnected second side edge portions defines an electrical wire receiving channel within which the electrical wire is received.

21. A decorative strip according to claim 20 in which the flexible material is heat fused along the boundaries of the apertures.

* * * * *

UNITED STATES PATENT AND TRADEMARK OFFICE

CERTIFICATE OF CORRECTION

PATENT NO. : 6,116,752
DATED : September 12, 2000
INVENTOR(S) : Mayfield et al.

It is certified that error appears in the above-identified patent and that said Letters Patent is hereby corrected as shown below:

Title page,
Under *Attorney, Agent, or Firm,* change "Leight" to -- Leigh --.

Column 3,
Lines 10-11, change "4-4 FIG. 3." to -- 4-4 of FIG. 3. --.
Line 52, change "suction cups hangers" to -- suction cup hangers --.

Column 4,
Line 64, change "is strip of ribbon which wrapped" to -- is a strip of ribbon which is wrapped --.

Column 5,
Line 52, change "claim 14" to -- claim 15 --.

Column 8,
Line 28, change "part" to -- apart --.
Line 38, change "wherein upright" to -- wherein the upright --.
Line 57, change "at at a" to -- at a --.

Signed and Sealed this

Tenth Day of September, 2002

*Attest:*

*Attesting Officer*

JAMES E. ROGAN
*Director of the United States Patent and Trademark Office*